US008634746B2

(12) United States Patent
Kamimura et al.

(10) Patent No.: US 8,634,746 B2
(45) Date of Patent: Jan. 21, 2014

(54) PHOTOSENSITIVE DRUM CARTRIDGE AND IMAGE FORMING APPARATUS

(75) Inventors: Naoya Kamimura, Ichinomiya (JP); Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 357 days.

(21) Appl. No.: 13/071,473

(22) Filed: Mar. 24, 2011

(65) Prior Publication Data

US 2011/0318051 A1 Dec. 29, 2011

(30) Foreign Application Priority Data

Jun. 25, 2010 (JP) ..... 2010-145371

(51) Int. Cl.
*G03G 21/16* (2006.01)

(52) U.S. Cl.
USPC ..... 399/111; 399/117; 399/123; 399/167; 399/353; 399/357

(58) Field of Classification Search
USPC ..... 399/11, 117, 123, 167, 353, 357, 111
See application file for complete search history.

(56) References Cited

U.S. PATENT DOCUMENTS

| | | | | |
|---|---|---|---|---|
| 2003/0185588 | A1 | 10/2003 | Takami | |
| 2007/0253729 | A1 | 11/2007 | Takagi | |
| 2008/0175617 | A1* | 7/2008 | Morishita | 399/99 |
| 2009/0169234 | A1* | 7/2009 | Kamimura | 399/357 |
| 2009/0180795 | A1* | 7/2009 | Karasawa et al. | 399/167 |

FOREIGN PATENT DOCUMENTS

| | | | |
|---|---|---|---|
| JP | H08-076595 | A | 3/1996 |
| JP | H09-062165 | A | 3/1997 |
| JP | 2002-351285 | A | 12/2002 |
| JP | 2003-195720 | A | 7/2003 |
| JP | 2003-295720 | A | 10/2003 |
| JP | 2007-316631 | A | 12/2007 |

* cited by examiner

*Primary Examiner* — Ryan Walsh
(74) *Attorney, Agent, or Firm* — Baker Botts L.L.P.

(57) ABSTRACT

A photosensitive drum cartridge and an image forming apparatus including the photosensitive drum cartridge are provided. The photosensitive drum cartridge includes: a photosensitive drum; a primary cleaning roller which is configured to contact a surface of the photosensitive drum to remove an attached matter on the surface of the photosensitive drum; a first gear which is configured to rotate together with the photosensitive drum; a second gear which is configured to rotate together with the primary cleaning roller; and a third gear which is configured to mesh with the first gear and the second gear, and which has a rotation axis, a position of which is fixed such that a distance from a rotation axis of the first gear is constant.

15 Claims, 9 Drawing Sheets

PHOTOSENSITIVE DRUM CARTRIDGE AND IMAGE FORMING APPARATUS

CROSS-REFERENCE TO RELATED APPLICATION

This application claims priority from Japanese Patent Application No. 2010-145371, filed on Jun. 25, 2010, the entire subject matter of which is incorporated herein by reference.

TECHNICAL FIELD

Aspects of the present invention relate to an image forming apparatus such as a laser printer, and a photosensitive drum cartridge that is provided in the image forming apparatus.

BACKGROUND

According to an example of an image forming apparatus, such as a laser printer, a drum unit that holds a photosensitive drum is detachably mounted to a main body of the apparatus.

The photosensitive drum has a cylindrical hollow drum main body and a drum shaft extending along a central axis line of the drum main body. The drum shaft is held to a frame of the drum unit so that it cannot be rotated. The drum main body is rotatably supported to the drum shaft. A flange is fitted to one end portion of the drum main body and a drum gear is connected to the other end portion thereof. When driving force of a motor is input to the drum gear, the photosensitive drum (drum main body) is rotated in a predetermined direction.

A developing unit that holds a developing roller is mounted to the frame. When the developing unit is mounted to the frame, the developing roller is pressure-contacted to the drum main body. While being pressure-contacted to the drum main body, the developing roller is rotated in a reverse direction with respect to a rotating direction of the photosensitive drum so that a part pressure-contacted to the drum main body is moved in the same direction as a surface of the drum main body. As the photosensitive drum and the developing roller are rotated, toner is supplied to the surface of the drum main body from the developing roller and an electrostatic latent image formed on the surface of the drum main body is developed into a toner image. In addition, a transfer roller is opposed to the drum main body. While opposed to the transfer roller, the toner image carried on the surface of the drum main body is transferred to a sheet that is introduced between the transfer roller and the drum main body.

A rotational speed of the drum main body should be kept to be constant during an image forming operation. In other words, when the rotational speed of the drum main body is changed, the electrostatic latent image formed on the surface of the drum main body is expanded and contracted and the image (toner image) formed on the sheet is thus expanded and contracted depending on the change, so that a quality of an image formed on the sheet deteriorates.

The rotational speed of the drum main body may be changed due to a disturbance input to the drum main body during the image forming operation. For example, when a leading end of the sheet introduced between the drum main body and the transfer roller contacts the surface of the drum main body, the surface of the drum main body is pushed by the leading end of the sheet and the drum main body may be thus encouraged to rotate. Thereby, the rotational speed of the drum main body is changed (increased).

In order to suppress the change in the rotational speed of the drum main body, a braking member is pressed for the flange fitted to the drum main body from a direction following the drum shaft. Specifically, the braking member is provided for the flange at a position opposite to the direction following the drum shaft, and a press member for pressing the braking member toward the flange is mounted between the braking member and the frame of the drum unit. The braking member is pressure-contacted to the flange by the pressing force of the press member and frictional force is applied to the flange from the braking member, so that the change in the rotational speed of the drum main body is suppressed (for example, see JP-A-2007-316631).

However, since it is necessary to additionally provide the braking member and the press member, cost increases due to the increase of the members.

SUMMARY

Accordingly, it is an aspect of the present invention to provide a photosensitive drum cartridge that can stabilize the rotational speed of the photosensitive drum and suppress the cost increasing, and an image forming apparatus including the photosensitive drum cartridge.

According to an illustrative embodiment of the present invention, there is provided a photosensitive drum cartridge including: a photosensitive drum; a primary cleaning roller which is configured to contact a surface of the photosensitive drum to remove an attached matter on the surface of the photosensitive drum; a first gear which is configured to rotate together with the photosensitive drum; a second gear which is configured to rotate together with the primary cleaning roller; and a third gear which is configured to mesh with the first gear and the second gear, and which has a rotation axis, a position of which is fixed such that a distance from a rotation axis of the first gear is constant.

According to another illustrative embodiment of the present invention, there is provided an image forming apparatus including: an apparatus main body; and the above photosensitive drum cartridge which is mounted to the apparatus main body.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Below, illustrative embodiments of the present invention will be described in detail with reference to the attached drawings.

1. Configuration of a Color Printer

Figure 1:
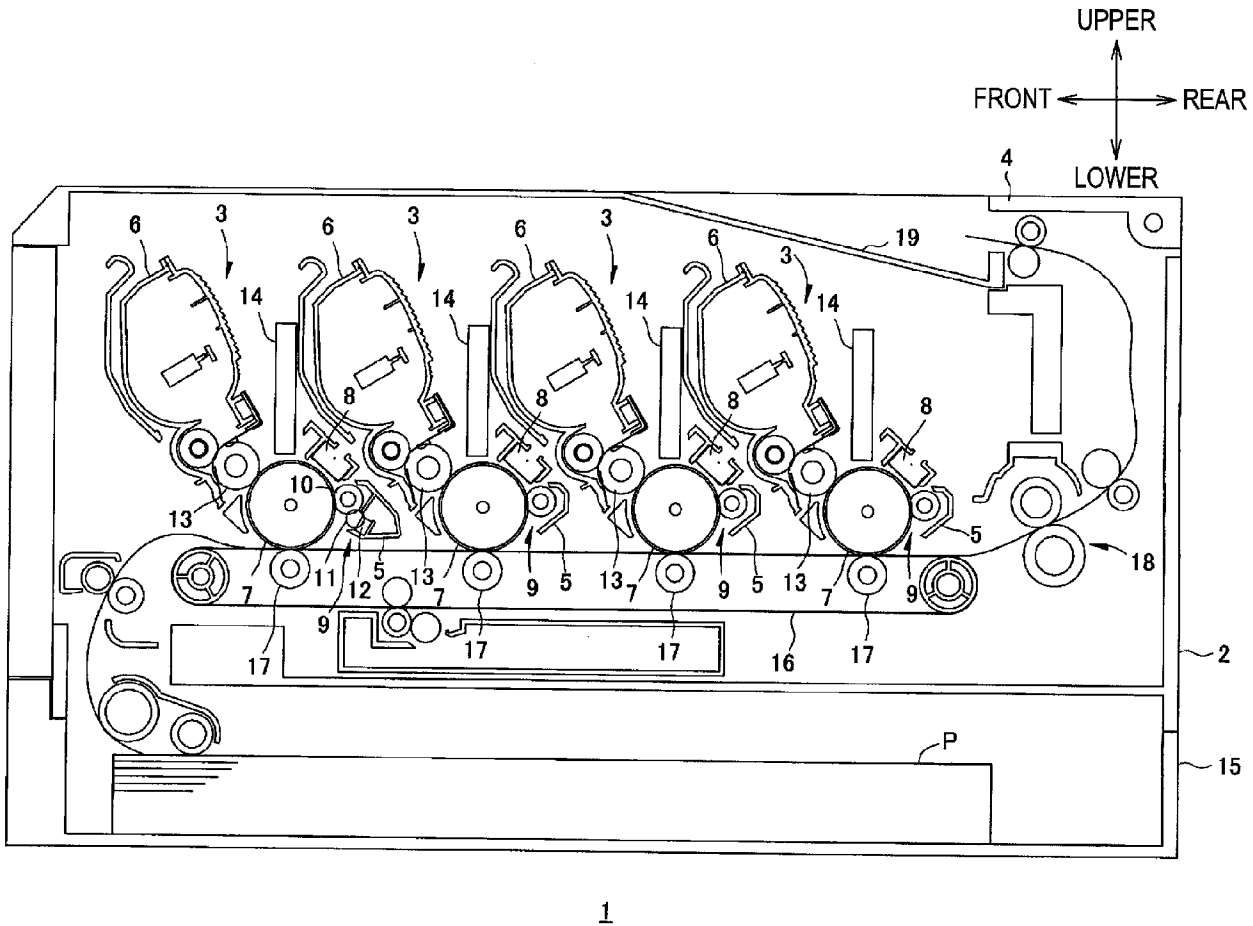
FIG. 1 is a section view of a color printer according to an illustrative embodiment of the present invention.

As shown in FIG. 1, a color printer 1 (an example of an image forming apparatus) is a tandem type color printer. The color printer 1 includes a body casing 2 (an example of an apparatus main body). Four process cartridges 3 are arranged in a predetermined direction in the body casing 2. Four process cartridges 3 are provide for black, yellow, magenta and cyan, and arranged in the order of black, yellow, magenta and cyan from one side in a predetermined direction. Each of the process cartridges 3 can be mounted to and removed from the body casing 2, when a top cover 4 at the top of the body casing 2 is opened.

In the meantime, the side (the left side in FIG. 1) at which the black process cartridge 3 is arranged is taken as a front side of the color printer 1. In addition, the left, right, upper and lower sides of the color printer 1 are determined when the color printer is seen from the front side. Unless otherwise mentioned specially, the process cartridge 3 is described based on the directions when it is mounted to the body casing 2.

Each of the process cartridges 3 includes a drum cartridge 5 (an example of a photosensitive drum cartridge), and a developing cartridge 6 which can be mounted to and removed from the drum cartridge 5.

The drum cartridge 5 includes a photosensitive drum 7, a charger 8 and a cleaner 9.

The charger 8 is a scorotron-type charger including wires and a grid.

The charger 8 is arranged at upper rear of the photosensitive drum 7.

The cleaner 9 behind the photosensitive drum 7 is arranged below the charger 8. The cleaner 9 removes an attached matter such as paper dust attached to the surface of the photosensitive drum 7.

The cleaner 9 included in the black process cartridge 3 (drum cartridge 5) which is arranged at the frontmost position includes a primary cleaning roller 10 for contacting the surface of the photosensitive drum 7 and removing the attached matter from the surface, a secondary cleaning roller 11 for contacting the surface of the primary cleaning roller 10 and removing from the surface the attached matter that is removed from the surface of the photosensitive drum 7 to the surface of the primary cleaning roller 10, and a contacting member 12 for contacting the surface of the secondary cleaning roller 11 and scraping out the attached matter that is removed from the surface of the primary cleaning roller 10 to the surface of the secondary cleaning roller 11.

The primary cleaning roller 10 and the secondary cleaning roller 11 are provided to be rotatable around the rotation axis extending in the left-right direction. The secondary cleaning roller 11 contacts the primary cleaning roller 10 from the lower and slightly rear direction. The contacting member 12 is arranged below the horizontal plane including the rotation axis of the secondary cleaning roller 11, and contacts the secondary cleaning roller 11 at the lower rear.

The developing cartridge 6 includes a developing roller 13. When the developing cartridge 6 is mounted to the drum cartridge 5, the developing roller 13 contacts the surface of the photosensitive drum 7 at the upper front.

LED units 14 corresponding to the respective photosensitive drums 7 are provided in the body casing 2. The front ends of the LED units 14 oppose the peripheral surfaces of the corresponding photosensitive drums 7, respectively.

After the surface of the photosensitive drum 7 is uniformly charged by the discharge of the charger 8, it is selectively exposed by the LEDs provided in the LED unit 14. Due to the exposure, the charges of the surface of the photosensitive drum 7 are selectively removed, and an electrostatic latent image is formed on the surface of the photosensitive drum 7. When the electrostatic latent image opposes the developing roller 13, toner is supplied from the developing roller 13 to the electrostatic latent image. In this way, a toner image is formed on the surface of the photosensitive drum 7.

A sheet cassette 15 for accommodating sheets P is arranged at the bottom of the body casing 2. The sheets P accommodated in the sheet cassette 15 are conveyed by various rollers to the conveying belt 16. The conveying belt 16 is arranged opposite to the four photosensitive drums 7 from lower side. Transferring rollers 17 are arranged in positions that are respectively opposite to the photosensitive drums 7 so that the upper side part of the conveying belt 16 is sandwiched between them. The sheets P conveyed to the conveying belt 16 sequentially move between the respective photosensitive drums 7 and the conveying belt 16 and with the movement of the conveying belt 16. Thus, toner images on the surface of the photosensitive drums 7 are transferred to the sheets P when they are opposite to the sheets P.

A fixer 18 is provided downstream from the conveying belt 16 in the conveying direction of the sheets P. The sheet onto which toner images are transferred is conveyed to the fixer 18. The fixer 18 fixes the toner images on the sheet P by heat and pressure. The sheet P on which the toner images are fixed is then discharged to the sheet discharging tray 19 at the top of the body casing 2 by various roller.

2. Drum Cartridge

Figure 2:
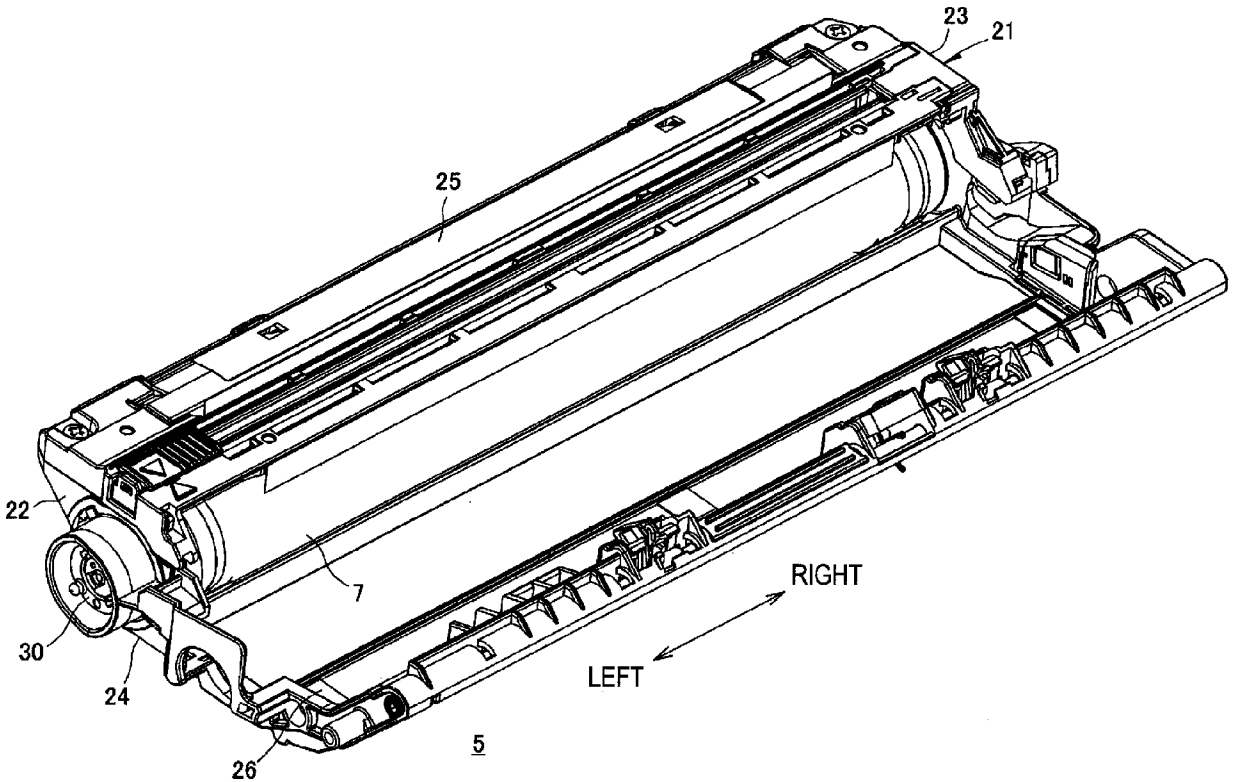
FIG. 2 is a perspective view of a black drum cartridge shown in FIG. 1.

As shown in FIG. 2, the black drum cartridge 5 includes a frame 21.

The frame 21 integrally has a pair of side plates 22 and 23 spaced opposite from each other in the left-right direction, a bottom plate 24 extending between the pair of side plates 22 and 23 and extending in the horizontal direction, an inclined plate 25 extending between the pair of side plates 22 and 23 and inclined towards the upper front, and a developing cartridge mounting portion 26 extending from the front end of the bottom plate 24 to the upper front. The developing cartridge 6 (see FIG. 1) is mounted to the developing cartridge mounting portion 26.

When viewed in the left-right direction, the side plates 22 and 23 are roughly triangular that become narrower at the lower rear. The bottom plate 24 is extended between one side of the roughly triangular side plate 22 and the corresponding side of the roughly triangular side plate 23, and the inclined plate 25 is extended between another side of the roughly triangular side plate 22 and the corresponding side of the roughly triangular side plate 23. The space surrounded by the side plates 22 and 23, the bottom plate 24 and the inclined plate 25 opens towards the developing cartridge mounting portion 26. Thus, the photosensitive drum 7, the charger 8, the primary cleaning roller 10, the secondary cleaning roller 11 and the contacting member 12 are accommodated in the above space. The photosensitive drum 7, the primary cleaning roller 10 and secondary cleaning roller 11 is provided to be rotatable between the pair of side plates 22 and 23. The charger 8 is supported at the inclined plate 25. The contacting member 12 is supported at the bottom plate 24.

The photosensitive drum 7 is supported by the ends of the side plates 22 and 23 at the side of the developing cartridge mounting portion 26, and a part of its surface exposes to the developing cartridge mounting portion 26. In this way, when the developing cartridge 6 is mounted into the developing cartridge mounting portion 26, the developing roller 13 contacts the part of the surface of the photosensitive drum 7 exposed to the developing cartridge mounting portion 26.

Figure 3:
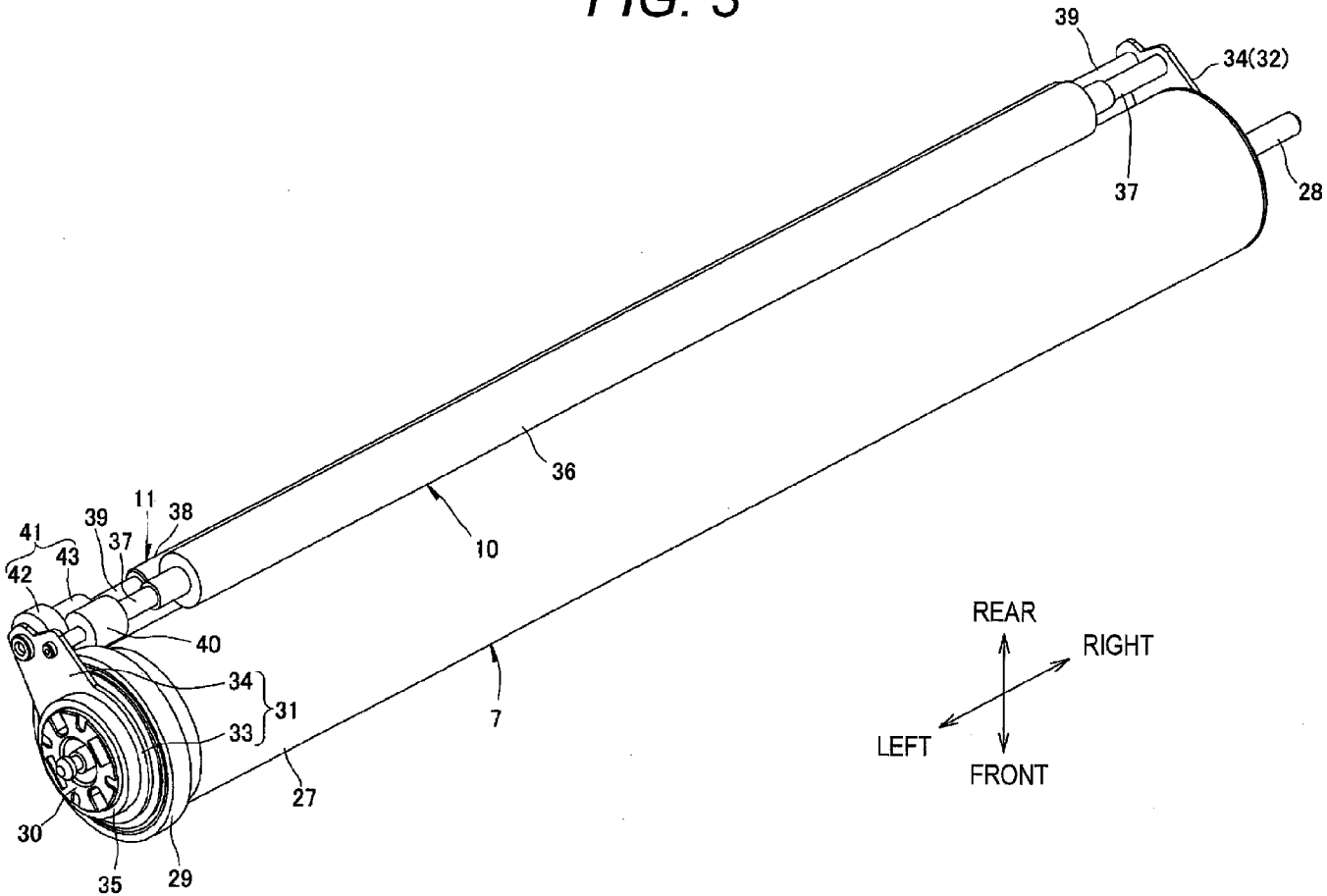
FIG. 3 is a perspective view of a photosensitive drum, a primary cleaning roller, a secondary cleaning roller, an inter-shaft distance fixing member, a drum gear, a primary cleaning gear and a secondary cleaning gear shown in FIG. 1.
Figure 4:
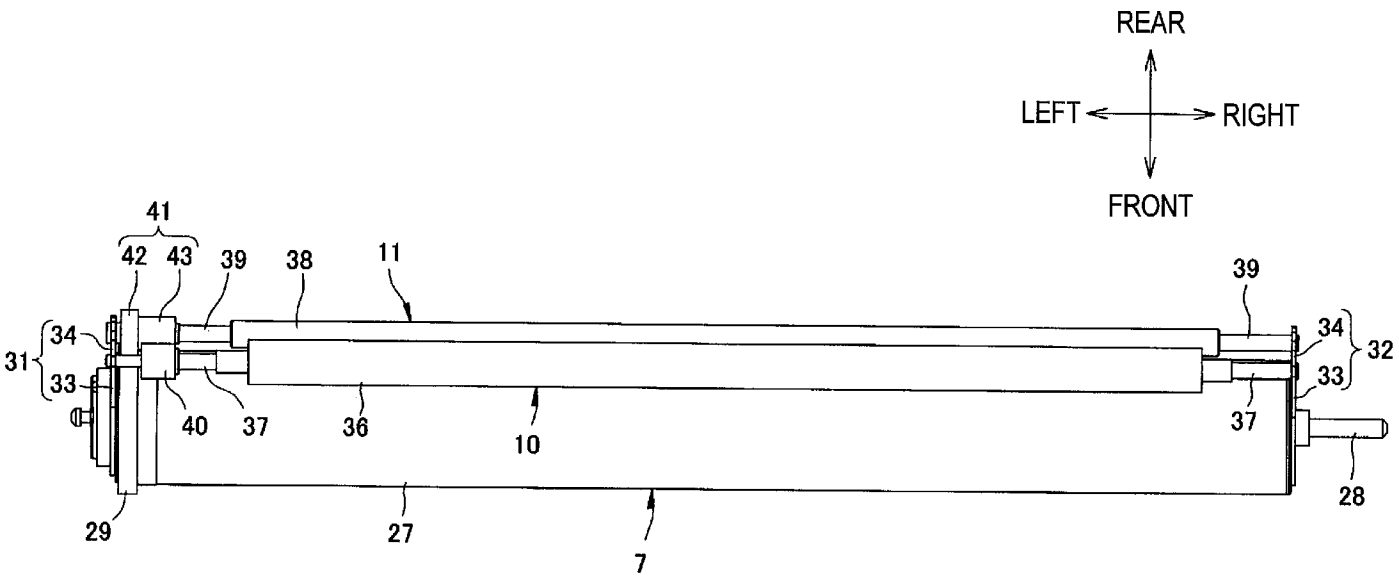
FIG. 4 is a plan view of the structure shown in FIG. 3.

As shown in FIG. 3 and FIG. 4, the photosensitive drum 7 includes a cylindrical drum body 27 and a drum shaft 28 which extend along the central axis of the drum body 27. The drum body 27 is rotatably supported by the drum shaft 28. A drum gear 29 (an example of a first gear) which has peripheral gear teeth is relatively unrotatably assembled to the left end of the drum body 27. A drum coupling 30 to which the driving force from a motor provided in the body casing 2 (not shown is provided at the left end surface of the drum gear 29. The drum coupling 30 exposes to the outside from the left side plate 22. When the driving force is input to the drum coupling 30, the drum body 27 rotates together with the drum gear 29.

Figure 5:
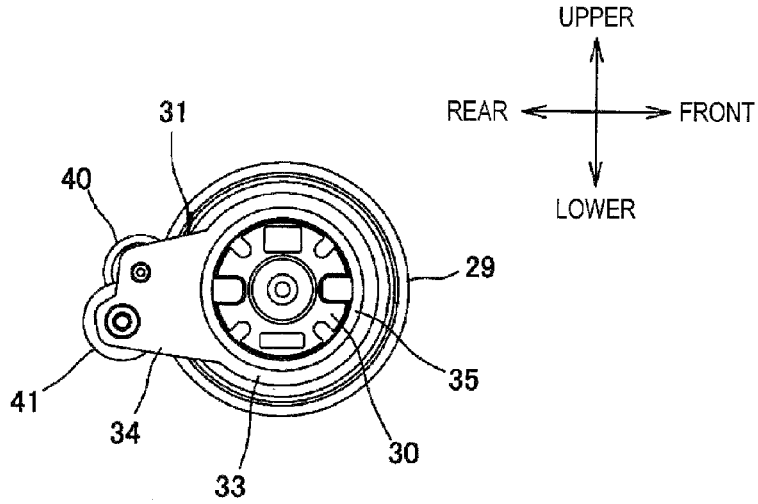
FIG. 5 is a left side view of the structure shown in FIG. 3.
Figure 6:
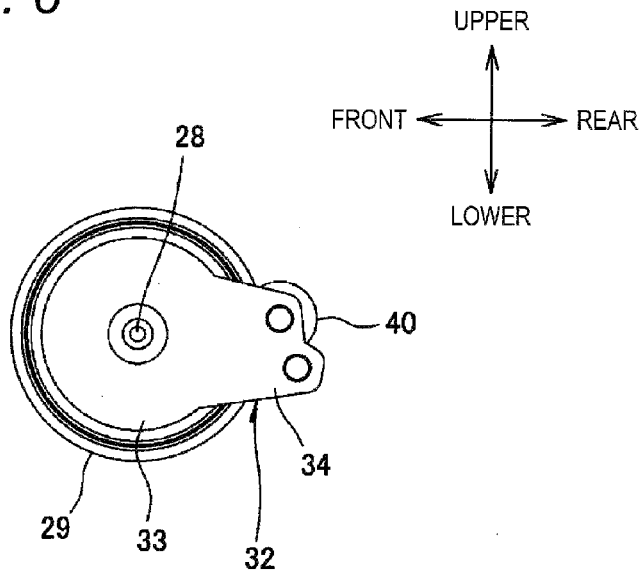
FIG. 6 is a right side view of the structure shown in FIG. 3.

In addition, a pair of intershaft distance fixing members 31 and 32 are provided to sandwich the drum body 27 of the photosensitive drum 7 from left and right. The intershaft distance fixing members 31 and 32 are made of resin material with high slidability such as POM (polyacetal), and have the same shape, as shown in FIGS. 5 and 6. Specifically, each of the intershaft distance fixing members 31 and 32 integrally has a drum opposing portion 33 which opposes the photosensitive drum 7 and is round when viewed from the side, and a shaft supporting portion 34 extending from the drum opposing portion 33 to the rear.

The drum coupling 30 is rotatably inserted through the drum opposing portion 33 of the intershaft distance fixing member 31 at the left side, as shown in FIGS. 3 and 5. Thus, at the left side surface of the drum opposing portion 33, a cylindrical coupling receiving portion 35 is integrally formed to surround the drum coupling 30.

The right end of the drum shaft 28 is inserted through the drum opposing portion 33 of the intershaft distance fixing member 32 at the right side, as shown in FIG. 6.

The primary cleaning roller 10, as shown in FIGS. 3 and 4, includes a cylindrical roller body 36 and a roller shaft 37 which extends along the central axis of the roller body 36 and protrudes from the end surfaces of the roller body 36. Plural brush hairs are provided around the roller body 36. That is, the primary cleaning roller 10 is a brush roller.

The secondary cleaning roller 11, as shown in FIGS. 3 and 4, includes a cylindrical roller body 38 and a roller shaft 39 which extends along the central axis of the roller body 38 and protrudes from the end surfaces of the roller body 38. The roller body 38 is made of sponge material, for example.

The roller shaft 37 of the primary cleaning roller 10 and the roller shaft 39 of the secondary cleaning roller 11, as shown in FIG. 3 and FIG. 4, are rotatably supported by the shaft supporting portions 34 of the intershaft distance fixing members 31 and 32. That is, the left ends of the roller shaft 37 of the primary cleaning roller 10 and the roller shaft 39 of the secondary cleaning roller 11 are rotatably inserted into the shaft supporting portion 34 of the left intershaft distance fixing member 31. In addition, the right ends of the roller shaft 37 of the primary cleaning roller 10 and the roller shaft 39 of the secondary cleaning roller 11 are rotatably inserted into the shaft supporting portion 34 of the right intershaft distance fixing member 32.

In this way, not only the distance between the rotation axis of the primary cleaning roller 10 and that of the secondary cleaning roller 11 is fixed to be constant, but also the distances between the above rotation axes and the rotation axis of the photosensitive drum 7 are fixed to be constant, respectively.

The intershaft distance fixing member 31 and 32 are respectively fixed to the side plates 22 and 23 so that the primary cleaning roller 10 is arranged at the back of the photosensitive drum 7 and the secondary cleaning roller 11 is arranged at the lower back of the primary cleaning roller 10.

At the roller shaft 37 of the primary cleaning roller 10, a primary cleaning gear 40 (an example of a second gear) which has peripheral gear teeth is relatively unrotatably provided between the roller body 36 and the left intershaft distance fixing member 31. The primary cleaning gear 40 is arranged at the right of the drum gear 29, and does not contact the drum gear 29.

At the roller shaft 39 of the secondary cleaning roller 11, a secondary cleaning gear 41 (an example of a third gear) which has peripheral gear teeth is relatively unrotatably provided between the roller body 38 and the left intershaft distance fixing member 31. The secondary cleaning gear 41 is configured as two step gears. The secondary cleaning gear 41 integrally has a drum gear meshing portion 42 which meshes with the drum gear 29, and a cleaning gear meshing portion 43 which meshes with the primary cleaning gear 40.

Figure 7:
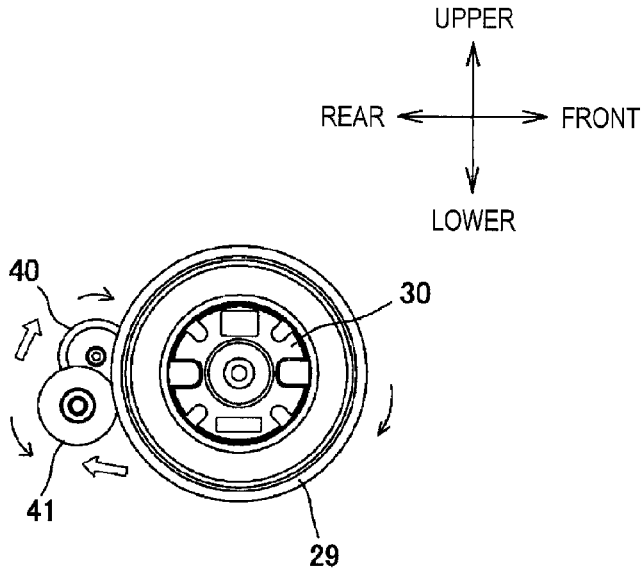
FIG. 7 is a left side view of the drum gear, the primary cleaning gear and the secondary cleaning gear.

When the drum gear 29 is rotated in a clockwise direction viewed from the left side by the driving force input to the drum coupling 30, as shown in FIG. 7, the rotation of the drum gear 29 is transferred to the secondary cleaning gear 41, and the secondary cleaning gear 41 rotates in a counterclockwise direction viewed from the left side. Thus, the rotation of the secondary cleaning gear 41 is transferred to the primary cleaning gear 40, and the primary cleaning gear 40 rotates in a clockwise direction viewed from the left side. In this way, the driving force input to the drum coupling 30 is successively transferred to the drum gear 29, the secondary cleaning gear 41 and the primary cleaning gear 40 in this order.

Figure 8:
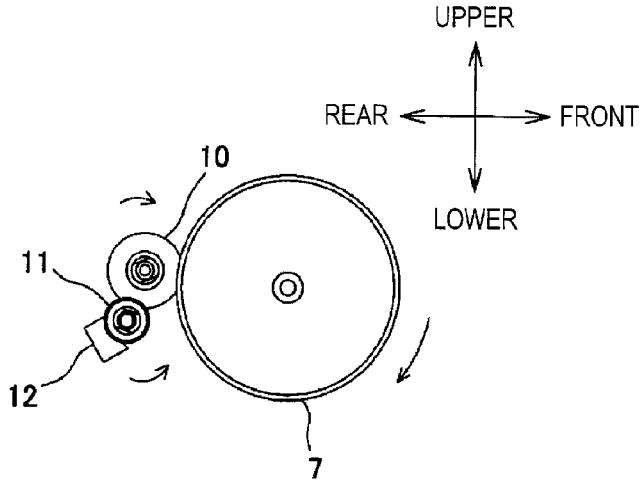
FIG. 8 is a left side view of the photosensitive drum, the primary cleaning roller and the secondary cleaning roller.

On the other hand, due to the rotation of the drum gear 29, the primary cleaning gear 40 and the secondary cleaning gear 41, the photosensitive drum 7, the primary cleaning roller 10 and the secondary cleaning roller 11 rotate together with the drum gear 29, the primary cleaning gear 40 and the secondary cleaning gear 41, respectively. As shown in FIG. 8, the photosensitive drum 7 rotates in a clockwise direction viewed from the left side. While the primary cleaning roller 10 contacts the surface of the photosensitive drum 7, the contacting part moves in a reverse direction to that of the surface of the photosensitive drum 7. That is, the primary cleaning roller 10 rotates in a clockwise direction viewed from the left side. While the secondary cleaning roller 11 contacts the surface of the primary cleaning roller 10, the contacting part moves in the same direction as that of the surface of the primary cleaning roller 10. That is, the secondary cleaning roller 11 rotates in a counterclockwise direction viewed from the left side.

In this case, the primary cleaning gear 40 and the secondary cleaning gear 41 are arranged so that the primary cleaning roller 10 rotates roughly at the same speed as the photosensitive drum 7. The primary cleaning roller 10 rotates so that surface of the part of the primary cleaning roller 10 that contacts the photosensitive drum 7 moves in a reverse direction to that of the surface of the photosensitive drum 7. Therefore, even there is no angular speed difference between the primary cleaning roller 10 and the photosensitive drum 7, the attached matter can be removed from the surface of the photosensitive drum 7 by the primary cleaning roller 10 since the primary cleaning roller 10 slidably scrapes the surface of the photosensitive drum 7 strongly.

3. Operational Effects (1) Operational Effect 1

As described above, the primary cleaning roller 10 contacts the surface of the photosensitive drum 7.

The drum gear 29, the primary cleaning gear 40 and the secondary cleaning gear 41 are included in the drum cartridge 5. The drum gear 29 and the primary cleaning gear 40 rotate together with the photosensitive drum 7 and the primary cleaning roller 10, respectively. The secondary cleaning gear 41 meshes with the drum gear 29 and the primary cleaning gear 40. Therefore, when the drum gear 29 and the photosensitive drum 7 are rotated by the driving force input to the drum gear 29, the rotation of the drum gear 29 is conveyed to the primary cleaning gear 40 via the secondary cleaning gear 41, so that the primary cleaning gear 40 and the primary cleaning roller 10 rotate.

Since the rotation of the drum gear 29 is conveyed to the primary cleaning gear 40 via the secondary cleaning gear 41, the primary cleaning roller 10 rotates in the same direction as the photosensitive drum 7 (against rotation), so that the surface of the part of the primary cleaning roller that contacts the photosensitive drum 7 moves in a reverse direction to that of the photosensitive drum 7. Therefore, the frictional force from the primary cleaning roller 10 is applied to the surface of the photosensitive drum 7, and the frictional force is against the rotation of the photosensitive drum 7. Therefore, the photosensitive drum 7 is rotated in a condition where small braking force is always applied (a condition where brake is always loosely applied). As a result, the rotational speed of the photosensitive drum 7 can be stabilized. In addition, because it is not necessary to additionally provide a braking member and a press member to stabilize the rotational speed, the increase of the cost can be prevented.

In addition, the position of the rotation axis of the secondary cleaning gear 41 is fixed so that its distance from the rotation axis of the drum gear 29 is constant. Therefore, for example, even if there exists variation in hardness or diameter of the roller body 36 of the primary cleaning roller 10, diameter change due to abrasive wear of the roller body 36 when the primary cleaning roller 10 is in use, or change in the contact condition between the photosensitive drum 7 and the roller body 36 due to rotation vibrations of the primary cleaning roller 10 and the photosensitive drum 7 and the like, the meshing condition between the drum gear 29 and the secondary cleaning gear 41 does not change. Thus, since the load applied to the drum gear 29 does not change, the drum gear 29 and the photosensitive drum 7 can be rotated more stably. In addition, since the rotation of the drum gear 29 can be conveyed to the primary cleaning gear 40 via the secondary cleaning gear 41, the primary cleaning gear 40 and the primary cleaning roller 10 can be stably rotated.

Furthermore, since the surfaces of the contacting parts of the photosensitive drum 7 and primary cleaning roller 10 move in directions reverse to each other, the attached matter on the surface of the photosensitive drum 7 is physically scraped by the primary cleaning roller 10. Therefore, the attached matter can be sufficiently removed from the surface of the photosensitive drum 7.

(2) Operational Effect 2

In addition, the position of the rotation axis of the primary cleaning gear 40 is fixed such that its distance from the rotation axis of the drum gear 29 is constant. In other words, the position of the primary cleaning gear 40 is fixed such that the distance between the rotation axis of the primary cleaning gear 40 and the rotation axis of the drum gear 29 is constant. Therefore, contacting condition between the photosensitive drum 7 and the roller body 36 does not change due to rotation vibrations of the primary cleaning roller 10 and the photosensitive drum 7. Thus, insufficient cleaning due to contacting condition change between the photosensitive drum 7 and the roller body 36 can be prevented. In other words, streaky attached matter which extends along the direction of the rotation axis and remain on the surface of the photosensitive drum 7 can be prevented.

(3) Operational Effect 3

Furthermore, the positions of the rotation axis of the primary cleaning gear 40 and the rotation axis of the secondary cleaning gear 41 are fixed such that the distance between these rotation axes is constant. In other words, the positions of the primary cleaning gear 40 and the secondary cleaning gear 41 are fixed such that the distance between the rotation axis of the primary cleaning gear 40 and the rotation axis of the secondary cleaning gear 41 is constant. In this way, not only the meshing condition of the drum gear 29 and the secondary cleaning gear 41, but also the meshing condition of the primary cleaning gear 40 and the secondary cleaning gear 41 are kept stable. Thus, since the rotation of the drum gear 29 can be conveyed to the primary cleaning gear 40 via the secondary cleaning gear 41, the primary cleaning gear 40 and the primary cleaning roller 10 can be stably rotated.

The positions of the respective rotation axes of the drum gear 29, the primary cleaning gear 40 and the secondary cleaning gear 41 are fixed by the intershaft distance fixing members 31 and 32. Therefore, it can be avoided to increase the cost for fixing them.

(4) Operational Effect 4

The secondary cleaning roller 11 contacts the surface of the primary cleaning roller 10. The attached matter removed from the surface of the photosensitive drum 7 to the surface of the primary cleaning roller 10 are removed from the surface of the primary cleaning roller 10 by the secondary cleaning roller 11. Therefore, the surface of the primary cleaning roller 10 can be kept clean.

(5) Operational Effect 5

The secondary cleaning roller 11 is separated from (does not contact) the surface of the photosensitive drum 7. Therefore, the attached matter from the surface of the secondary cleaning roller 11 can be prevented from attaching to the surface of the photosensitive drum 7 again.

(6) Operational Effect 6

The contacting member 12 contacts the surface of the secondary cleaning roller 11. The attached matter removed from the surface of the primary cleaning roller 10 to the surface of the secondary cleaning roller 11 are removed from the surface of the secondary cleaning roller 11 by the contacting member 12.

The rotation axis of the secondary cleaning gear 41 which rotates together with the secondary cleaning roller 11 is arranged below the horizontal plane including the rotation axis of the primary cleaning gear 40 which rotates together with the primary cleaning roller 10. Then, the contacting member 12 is arranged below the horizontal plane including the rotation axis of the secondary cleaning gear 41. In this way, the attached matter removed from the surface of the secondary cleaning roller 11 can be prevented from attaching to the surface of the primary cleaning roller 10 again.

(7) Operational Effect 7

The primary cleaning roller 10 is a brush roller. For the primary cleaning roller 10, a sponge roller may be used, but it may be advantageous that a brush roller is used.

In order to have sufficient cleaning performance, the primary cleaning roller 10 should be pressed against the surface of the photosensitive drum 7 by suitable force. To this end, since the primary cleaning roller 10 is pressed against the surface of the photosensitive drum 7, a certain crushing amount has to be ensured. When the primary cleaning roller 10 is a sponge roller whose elasticity is relatively high, in order to ensure a certain crushing amount for the primary cleaning roller 10, it is difficult to relatively fix the respective positions of the drum gear 29 and the primary cleaning gear 40, regardless of the dimensional tolerances of these members, and it is necessary to provide the primary cleaning roller 10 with a press member such as a spring to press against the photosensitive drum 7. If the primary cleaning roller 10 is a brush roller, since its elasticity is lower than a sponger roller, even if the positions of the drum gear 29 and the primary cleaning gear 40 are relatively fixed, regardless of the dimensional tolerances of the members, the primary cleaning roller 10 can be pressed against the surface of the photosensitive drum 7 by suitable force.

4. Second Illustrative Embodiment

The configuration for keeping constant the distance between the rotation axis of the drum gear 29 and the rotation axis of the secondary cleaning gear 41 is not limited to the configuration shown in FIGS. 3 and 4. Instead of the configuration shown in FIGS. 3 and 4, for example, the configuration shown in FIGS. 9 and 10 can be also used.

Figure 9:
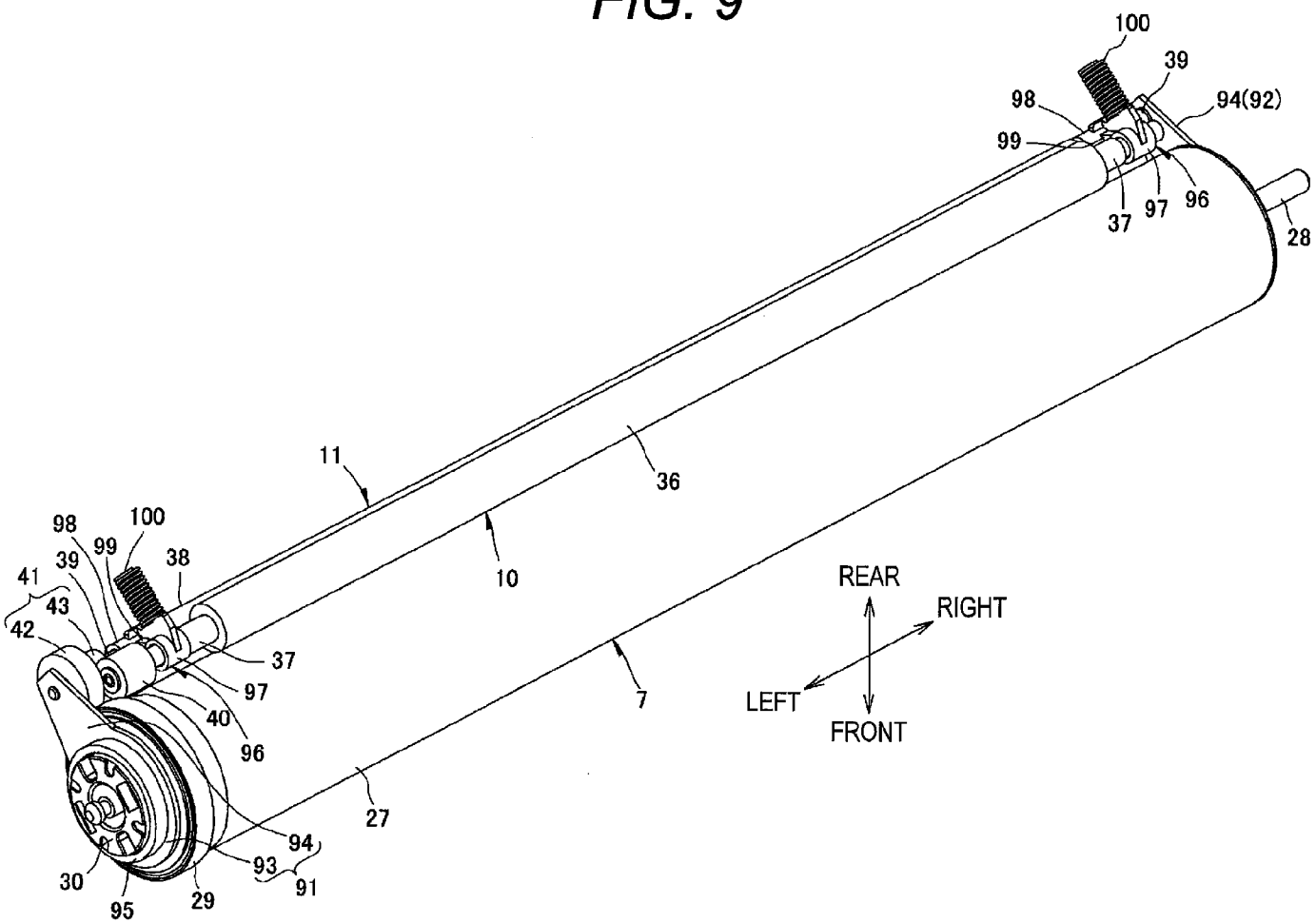
FIG. 9 is a perspective view of another structure that can be alternatively used as the structure shown in FIG. 3, and shows a photosensitive drum, a primary cleaning roller, a secondary cleaning roller, an intershaft distance fixing member, a drum gear, a primary cleaning gear, a secondary cleaning gear and a shaft connecting member.
Figure 10:
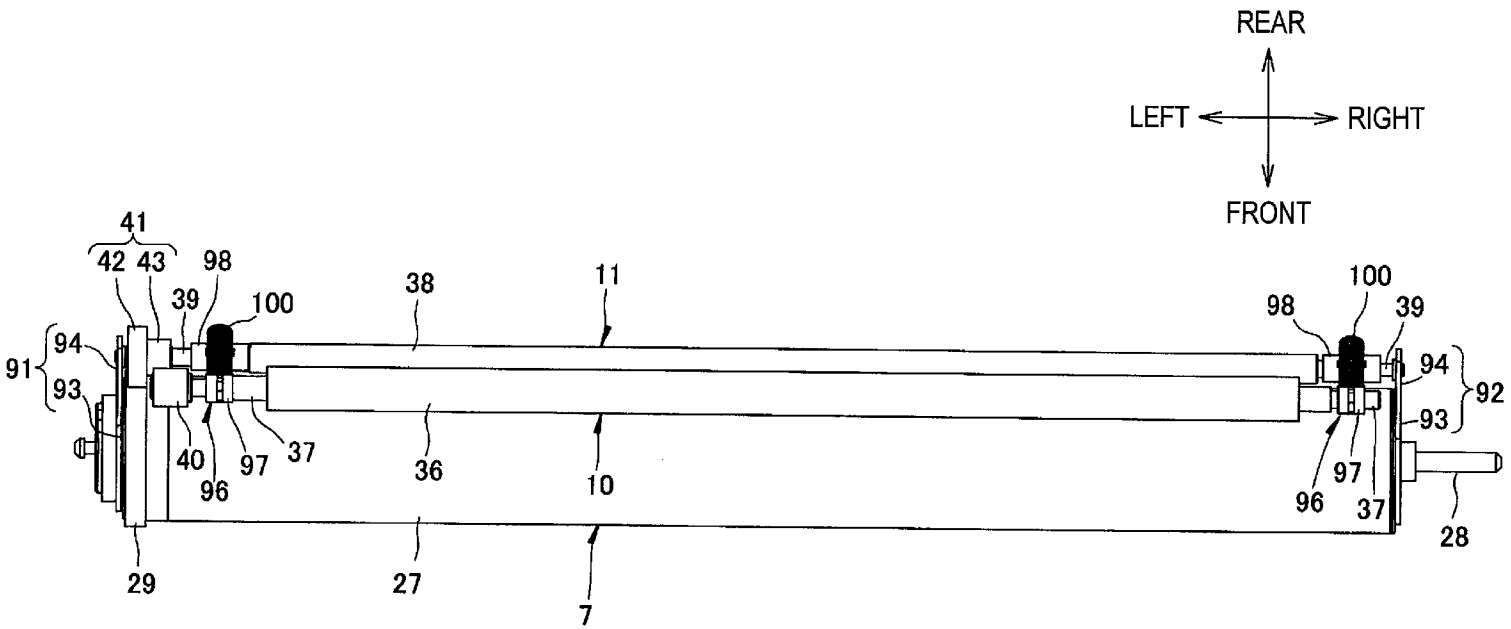
FIG. 10 is a plan view of the structure shown in FIG. 9.

In FIGS. 9 and 10, the parts corresponding to those shown in FIGS. 3 and 4 are attached the same reference symbols as those of the corresponding part, respectively. Thus, the differences between the configuration shown in FIGS. 9 and 10 and that shown in FIGS. 3 and 4 are explained below, but the description of those parts given the same reference symbols is omitted.

Figure 11:
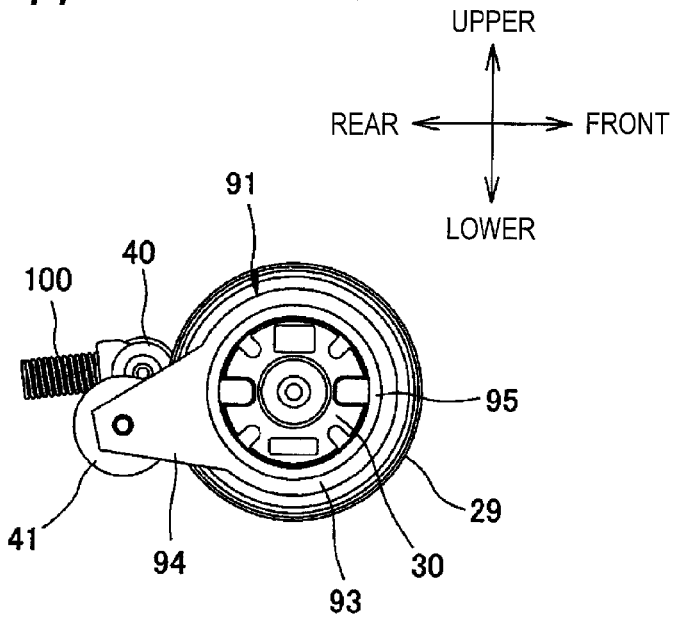
FIG. 11 is a left side view of the structure shown in FIG. 9.
Figure 12:
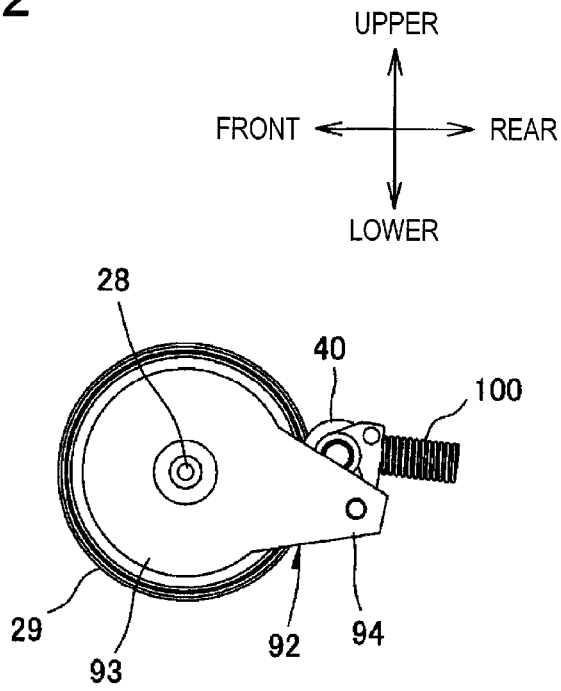
FIG. 12 is a right side view of the structure shown in FIG. 9.

As shown in FIGS. 9 and 10, a pair of intershaft distance fixing members 91 and 92 are provided such that the drum body 27 of the photosensitive drum 7 are sandwiched from left and right. The intershaft distance fixing members 91 and 92 are made of resin material with high slidability such as POM, and have the same shape, as shown in FIGS. 11 and 12. In particular, each of the intershaft distance fixing members 91 and 92 integrally has a drum opposing portion 93 which opposes the photosensitive drum 7 and is round when viewed from the side, and a shaft supporting portion 94 extending from the drum opposing portion 93 to the rear.

The drum coupling 30 is rotatably inserted through the drum opposing portion 93 of the intershaft distance fixing member 91 at the left side, as shown in FIGS. 9 and 11. Then, at the left side surface of the drum opposing portion 93, a cylindrical coupling receiving portion 95 is integrally formed to surround the drum coupling 30.

The right end of the drum shaft 28 is inserted through the drum opposing portion 93 of the intershaft distance fixing member 92 at the right side, as shown in FIG. 12.

The primary cleaning roller is a sponge roller.

The roller shaft 37 of the primary cleaning roller 10, as shown in FIG. 9 and FIG. 10, is rotatably supported by the shaft supporting portions 94 of the intershaft distance fixing members 91 and 92. That is, the left end of the roller shaft 37 of the primary cleaning roller 10 is rotatably inserted through the shaft supporting portion 94 of the intershaft distance fixing member 91 at the left side. In addition, the right end of the roller shaft 37 of the primary cleaning roller 10 is rotatably inserted through the shaft supporting portion 94 of the intershaft distance fixing member 92 at the right side.

The roller shaft 37 of the primary cleaning roller 10 and the roller shaft 39 of the secondary cleaning roller 11 are connected by a shaft connecting members 96 at both ends of them. As shown in FIG. 9, the shaft connecting member 96 integrally has a cylindrical first insertion portion 97 through which the roller shaft 37 is rotatably inserted, a cylindrical second insertion portion 98 through which the roller shaft 39 is rotatably inserted, and a connecting portion 99 for connecting the first insertion portion 97 and the second insertion portion 98. The part of the roller shaft 37 between the roller body 36 and the primary cleaning gear 40 is inserted through the first insertion portion 97. The part of the roller shaft 39 between the roller body 38 and the secondary cleaning gear 41 is inserted through the second insertion portion 98.

Then, one end of the coil spring 100 is connected to the first insertion portion 97. The other end of the coil spring 100 is connected to the frame 21 of the drum cartridge 5 (see FIG. 2). The coil spring 100 is interposed between the frame 21 and the first insertion portion 97 in a compressed state. Therefore, the coil spring 100 presses the first insertion portion 97 to the photosensitive drum 7, and in this way the primary cleaning roller 10 contacts the surface of the photosensitive drum 7 under suitable pressure.

In this configuration, the position of the rotation axis of the secondary cleaning gear 41 is also fixed such that its distance from the rotation axis of the drum gear 29 is constant. Therefore, for example, even if there exists variation in hardness or diameter of the roller body 36 of the primary cleaning roller 10, diameter change due to abrasive wear of the roller body 36 when the primary cleaning roller 10 is in use, or change in the contact condition between the photosensitive drum 7 and the roller body 36 due to rotation vibrations of the primary cleaning roller 10 and the photosensitive drum 7 and the like, the meshing condition between the drum gear 29 and the secondary cleaning gear 41 does not change. Thus, since the load applied to the drum gear 29 does not change, the drum gear 29 and the photosensitive drum 7 can rotate more stably. In addition, since it is not necessary to additionally provide a braking member and a press member to stabilize the rotational speed, the cost can be prevented from increasing.

In addition, the intershaft distance fixing members 91 and 92 fixes the primary cleaning gear 40 and the secondary cleaning gear 41 such that the distance between the rotation axis of the primary cleaning gear 40 and the rotation axis of the secondary cleaning gear 41 is constant. In this way, the meshing condition of the primary cleaning gear 40 and the secondary cleaning gear 41 becomes stable.

5. Modified Examples

While the present invention has been shown and described with reference to certain illustrative embodiments thereof, it will be understood by those skilled in the art that various changes in form and details may be made therein without departing from the spirit and scope of the invention as defined by the appended claims.

For example, the present invention is not limited to the black drum cartridge (photosensitive drum cartridge), but also applicable to yellow, magenta and cyan drum cartridges.

In addition, the inventive concept of the present invention is not limited to a color printer, but also applicable to a monochrome printer.

In the above illustrative embodiment, the drum cartridge 5 and the developing cartridge 6 are separately configured (the developing cartridge 6 is detachably mounted to the drum cartridge 5). However, the drum cartridge 5 and the developing cartridge 6 may be integrated.

What is claimed is:

1. A photosensitive drum cartridge comprising:

a photosensitive drum;

a primary cleaning roller which is configured to contact a surface of the photosensitive drum to remove an attached matter on the surface of the photosensitive drum;

a first gear which is configured to rotate together with the photosensitive drum;

a second gear which is configured to rotate together with the primary cleaning roller;

a third gear which is configured to mesh with the first gear and the second gear, and which has a rotation axis, a position of which is fixed such that a distance from a rotation axis of the first gear is constant; and an intershaft distance fixing member which fixes the respective positions of the rotation axes of the first gear, the second gear and the third gear such that the distance between the rotation axis of the first gear and the rotation axis of the second gear, the distance between the rotation axis of the second gear and the rotation axis of the third gear and the distance between the rotation axis of the third gear and the rotation axis of the first gear are constant, respectively.

2. The photosensitive drum cartridge according to claim 1, further comprising:

a secondary cleaning roller configured to contact the surface of the primary cleaning roller to remove an attached matter removed from photosensitive drum to the surface of the primary cleaning roller, wherein the third gear is configured to rotate together with the secondary cleaning roller.

3. The photosensitive drum cartridge according to claim 2, wherein the secondary cleaning roller is separated from the surface of the photosensitive drum.

4. The photosensitive drum cartridge according to claim 2, further comprising:

a contacting member which is configured to contact the surface of the secondary cleaning roller, wherein the rotation axis of the third gear is arranged below the horizontal plane including the rotation axis of the second gear, and wherein the contacting member is arranged below the horizontal plane including the rotation axis of the third gear.

5. The photosensitive drum cartridge according to claim 1, wherein the primary cleaning roller is a brush roller.

6. A photosensitive drum cartridge comprising:

a pair of side plates;

a photosensitive drum which is supported by the side plates to be rotatable about a rotation axis;

a drum gear which is unrotatably provided to the photosensitive drum at one side thereof in a direction of the rotation axis;

a primary cleaning roller which is supported by the side plates to be rotatable and configured to contact a surface of the photosensitive drum to clean the surface of the photosensitive drum;

a primary cleaning gear which is unrotatably provided to the primary cleaning roller at one side thereof in the direction of the rotation axis;

a secondary cleaning roller which is supported by the side plates and configured to contact a surface of the primary cleaning roller to clean the surface of the primary cleaning roller; and a secondary cleaning gear which is unrotatably provided to the secondary cleaning roller at one side thereof in the direction of the rotation axis, wherein the drum gear meshes with the secondary cleaning gear without meshing the primary cleaning gear, and the secondary cleaning gear meshes with the primary cleaning gear.

7. A photosensitive drum cartridge comprising:

a photosensitive drum;

a primary cleaning roller which is configured to contact a surface of the photosensitive drum to remove an attached matter on the surface of the photosensitive drum;

a first gear which is configured to rotate together with the photosensitive drum;

a second gear which is configured to rotate together with the primary cleaning roller; and a third gear which is configured to mesh with the first gear and the second gear, and which has a rotation axis, a position of which is fixed such that a distance from a rotation axis of the first gear is constant, wherein the primary cleaning roller is configured to rotate in a same rotation direction as a rotation direction of the photosensitive drum.

8. The photosensitive drum cartridge according to claim 7, wherein the second gear is configured to rotate coaxially with the primary cleaning roller.

9. The photosensitive drum cartridge according to claim 8, wherein a position of a rotation axis of the second gear is fixed such that a distance from the rotation axis of the first gear is constant.

10. The photosensitive drum cartridge according to claim 9, further comprising:

an intershaft distance fixing member which fixes the respective positions of the rotation axes of the first gear, the second gear and the third gear such that the distance between the rotation axis of the first gear and the rotation axis of the second gear, the distance between the rotation axis of the second gear and the rotation axis of the third gear and the distance between the rotation axis of the third gear and the rotation axis of the first gear are constant, respectively.

11. The photosensitive drum cartridge according to claim 8, further comprising:

a secondary cleaning roller configured to contact the surface of the primary cleaning roller to remove an attached matter removed from photosensitive drum to the surface of the primary cleaning roller, wherein the third gear rotates together with the secondary cleaning roller.

12. The photosensitive drum cartridge according to claim 11, wherein the secondary cleaning roller is separated from the surface of the photosensitive drum.

13. The photosensitive drum cartridge according to claim 11, further comprising:

a contacting member which is configured to contact the surface of the secondary cleaning roller, wherein the rotation axis of the third gear is arranged below the horizontal plane including the rotation axis of the second gear, and wherein the contacting member is arranged below the horizontal plane including the rotation axis of the third gear.

14. The photosensitive drum cartridge according to claim 8, wherein the primary cleaning roller is a brush roller.

15. The photosensitive drum cartridge according to claim 7, wherein the second gear is relatively unrotatably provided to the primary cleaning roller.

* * * * *